US006290417B1

(12) United States Patent
Kaminski

(10) Patent No.: US 6,290,417 B1
(45) Date of Patent: Sep. 18, 2001

(54) ORAL HYGIENE DEVICE

(76) Inventor: Basia Kaminski, 2019 Glasco Tpk., Woodstock, NY (US) 12498

( * ) Notice: Subject to any disclaimer, the term of this patent is extended or adjusted under 35 U.S.C. 154(b) by 0 days.

(21) Appl. No.: 09/483,928

(22) Filed: Jan. 18, 2000

(51) Int. Cl.[7] ..... A46B 11/00

(52) U.S. Cl. ..... 401/123; 401/19; 401/31; 401/124; 401/125; 401/269

(58) Field of Search ..... 401/123, 19, 30, 401/31, 32, 269, 38, 39, 124, 118, 125, 7

(56) References Cited

U.S. PATENT DOCUMENTS

| | | | | |
|---|---|---|---|---|
| D. 403,512 | | 1/1999 | Hennings | D4/108 |
| 2,391,371 | | 12/1945 | Watt | 206/15.1 |
| 2,512,935 | | 6/1950 | Hansen | 132/84 |
| 2,656,843 | * | 10/1953 | Boulicault | 401/269 |
| 3,294,100 | * | 12/1966 | Adcock | 401/269 |
| 3,771,881 | | 11/1973 | Swenson | 401/75 |
| 4,275,750 | * | 6/1981 | Clark | 401/123 |
| 4,388,011 | | 6/1983 | Smtih | 401/173 |
| 4,408,920 | * | 10/1983 | Walther et al. | 401/269 |
| 4,457,641 | | 7/1984 | Smith | 401/135 |
| 4,917,133 | | 4/1990 | Morel | 132/318 |
| 5,028,158 | | 7/1991 | Fey | 401/183 |
| 5,044,386 | * | 9/1991 | Nelson | 401/123 |
| 5,769,553 | | 7/1998 | Chaudhri et al. | 401/195 |

* cited by examiner

*Primary Examiner*—David J. Walczak

(57) ABSTRACT

An oral hygiene device including a combination toothbrush and semi-hard toothpaste in a container. The semi-hard toothpaste includes baking soda flavoring and a hardener.

7 Claims, 3 Drawing Sheets

ORAL HYGIENE DEVICE

BACKGROUND OF THE INVENTION

1. Field of the Invention

This invention relates to an oral hygiene device for use when traveling and more particularly to a combination dentifrice and toothbrush and to a semi-hard dentifrice stick for use in the oral hygiene device.

2. Prior Art and Objects

The need for an oral hygiene device for use when away from home has been long recognized. The need is obvious and has been felt by virtually everyone. A variety of attempts to meet the need have been provided. The major difficulty appears to have been the dentifrice which has been understandably standard toothpaste such as would be used at home. Toothpaste in a tube or can, which is soft is well known, and readily commercially available. Its effectiveness is accepted but when kept in a pocket or pocketbook, due to a cap coming off or a puncture in the container, such toothpaste can result in spillage with all the resultant problems.

One attempt at what appears to have been intended as a combination toothbrush and toothpaste dispenser is shown in the Hennings Patent, Des. 403,512. A handle is provided which stores toothpaste and which dispenses toothpaste by pressing a lever on the side of the handle to force the lever toward the toothbrush mounted on one end of the handle thereby forcing toothpaste from the handle into the toothbrush by means of a channel in an extension on which the toothbrush is mounted. Obviously, accidental movement of the lever will result in the spillage as just previously discussed. Also, as with all combinations of a toothbrush and dentifrice using toothpaste where the toothpaste is forced into bristles of the toothbrush, the paste will hardened when exposed to the air and thus will clog the channel from the paste container to the bristles of the toothbrush.

The Chaudhri et. al. Patent, U.S. Pat. No. 5,769,553, discloses a handle which forces toothpaste into the bristles of a toothbrush through a channel in a member on which the toothbrush bristles are mounted when the handle is turned. The handle also contains mouthwash and dental floss. The problem of an undesired release of paste as well as hardening of the paste in the channel remains the areas of concern. The device is also comparatively complex and thus will be comparatively expensive.

The Fey Patent, U.S. Pat. No. 5,028,158, meets some of the problems by using a capped unit with a tube of toothpaste. Spillage should therefore be retained in the cap but a channel is used to force the toothpaste into the bristles of the toothbrush and hardening can occur thereby blocking the channel. Spillage within the cap, althlugh preferable to spillage directly into a pocket, is still not desirable.

The Smith Patents, U.S. Pat. Nos. 4,388,011 and 4,457,64, teach a complicated and thus apparently expensive device for feeding either soft products, such as toothpaste or hardened sticks, such as lipstick. The embodiment of the Smith device for use with a toothbrush is limited to the use of a soft paste with all of the problems previously associated with the use of paste.

The Hanson Patent, U.S. Pat. No. 2,512,935, teaches a handle which is cylindrical and into which a toothbrush mounted on a hollow tube can be placed for storage. Upon removal, the toothbrush can be mounted on one end of the handle. A compartment is located on the end of the hollow tube to store which is most probably a powder, can be stored. Another compartment within the device is provided to store makeup.

A semi-hard dentifrice permits application by placing the dentifrice directly onto the teeth. Plugging of a conduit by drying toothpaste is not possible. Spillage is also not possible.

Accordingly, it is an object of the present invention to provide a combination toothbrush and dentifrice that can be carried easily without spillage.

It is a further object of the present invention to provide a combination toothbrush and dentifrice that can easily used when traveling even without bathroom facilities.

It is a further object of the present invention to provide a dentifrice that is semi-hard and which can be used with the combination toothbrush and dentifrice.

It is a further object of the present invention to provide a combination toothbrush and dentifrice that is simple in design and that can be economically produced and that is durable.

It is a further object of the present invention to provide a combination toothbrush and dentifrice that prevents spillage or damage to clothing from either the toothbrush or the dentifrice while also preventing contamination to the toothbrush and the dentifrice.

These and other objects and advantages of the present invention will become apparent to those of ordinary skill in the art as the description thereof proceeds.

SUMMARY OF THE INVENTION

A semi-hard dentifrice is provided as well as a combination toothbrush and dentifrice using a semi-hard dentifrice. The toothbrush and the dentifrice are mounted in axial alignment but directed in opposite directions. Each is secured in a holder which is part of a case in which the toothbrush and the dentifrice are mounted. Either the toothbrush or the dentifrice may optionally be mounted so as to retractable into the holder. Caps are provided to mount over the dentifrice and the toothbrush.

The dentifrice is essentially uses baking soda as a cleaning agent and forms the baking soda into a semi-hard stick by use of hardeners and optimally along with a flavoring.

DESCRIPTION OF THE PREFERRED EMBODIMENT

Figure 1:
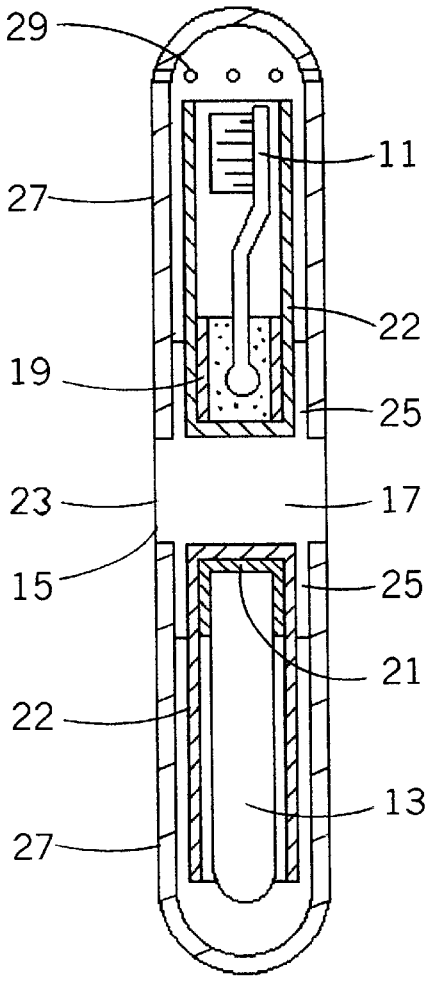
FIG. 1 is a cross-sectional view of the oral hygiene device with the toothbrush and the dentifrice retracted and with the caps in place.
Figure 2:
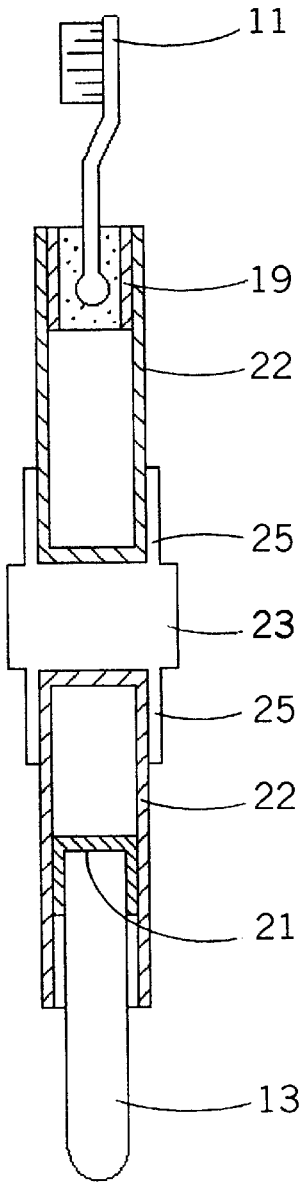
FIG. 2 is a cross-sectional view with the toothbrush and the dentifrice extended and the caps removed.
Figure 3:
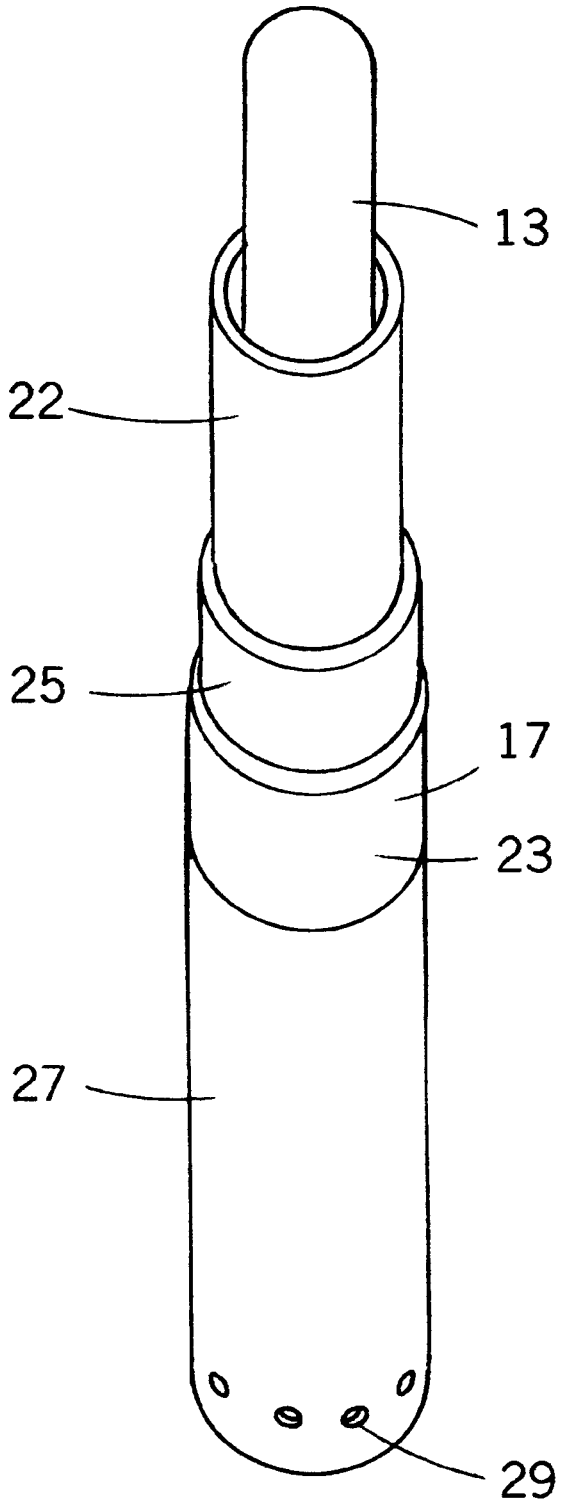
FIG. 3 is a pictorial view with the cap over the dentifrice removed and with the dentifrice extended and with the cap over the toothbrush in place.
Figure 4:
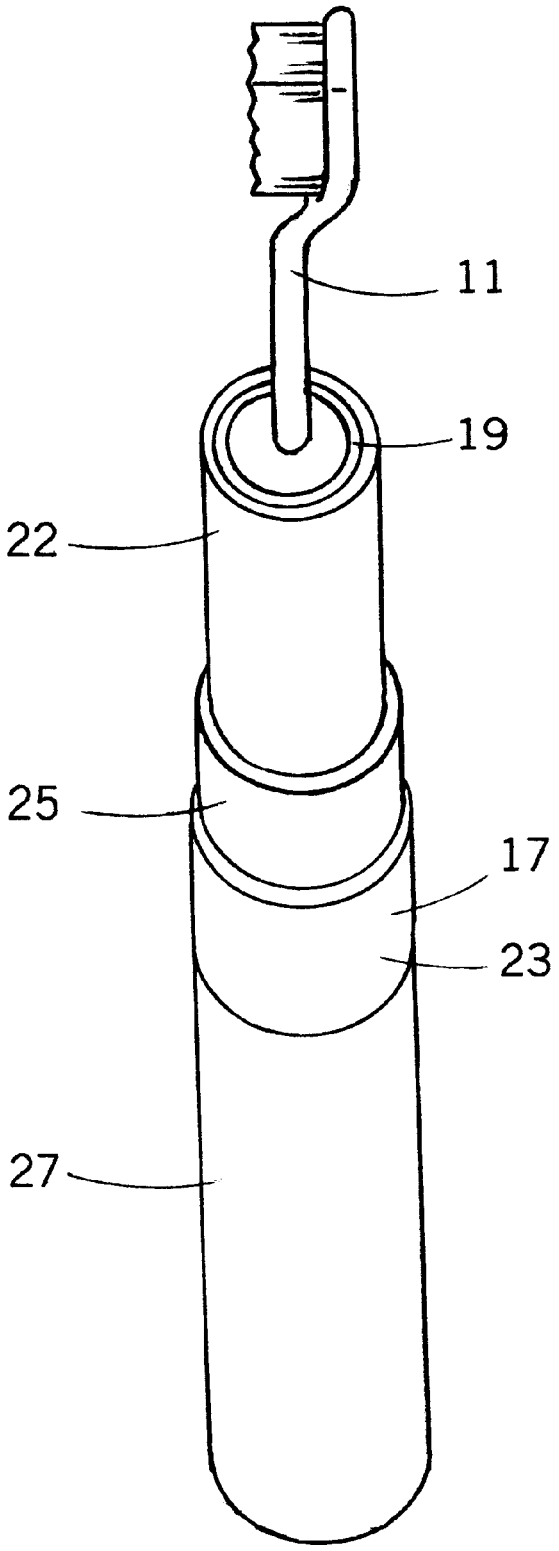
FIG. 4 is a pictorial view with the toothbrush extended and the cap over the toothbrush removed and with the cap over the dentifrice in place.

Referring now to FIGS. 1–4., an oral hygiene device is shown including in combination both a toothbrush 11 and a dentifrice 13. The entire oral hygiene device is mounted and enclosed within a case 15 which has several parts. It is most preferred that the oral hygiene device be produced in one piece with both the toothbrush 11 and the dentifrice 13 in the same case 15 as both are essential to one another and one may be separated from one another if not retained within one case 15.

The case 15 has a center section 17 and a brush mount 19 and a dentifrice mount 21. The brush mount 19 and the dentifrice mount 21 are secured to the center section 17 and extend fron the center section 17 in opposite directions but are axially aligned with one another. The brush mount 19 and the dentifrice mount 21 in their simplest form are a sleeve, most likely cylindrical, in which the toothbrush 11 and the dentifrice 13 are respectively fixedly mounted. In a more advanced embodiment, the dentifrice 13 and the toothbrush 11 may be retractable into their respective mounts 19 ,21 and may then be advanced from their respective mounts 19, 21 to be used. The means for advancing and retracting the toothbrush 11 and the dentifrice 13 are known in the art and have been used for many years in lipstick containers and lip balm containers. The advancing and retracting of the dentifrice 13 and the toothbrush 11 may be activated by turning the propel-repel dispenser 22 in which the dentifrice mount 15–21 and the brush mount 19 respectively, are located. The propel-repel dispenser 22 is shown in simplified form as such dispenses 22 already exist. Other, more simple versions of a propel-repel dispenser 22, may only require a lever (not shown) on the side of the mounts 19,21 which can be pressed in the desired direction and placed into a notch to hold either the dentifrice 13 or the toothbrush 11 in the desired position. The mechanisms for retracting and advancing the dentifrice 13 and the toothbrush 11 are known and thus are not being described in detail herein. One example of a mechanism for retracting and advancing, also referred to as propel-repel dispensers is described in the Swensen Patent, U.S. Pat. No. 3,771,881 and a different version is described in the Morel Patent, U.S. Pat. No. 4,917,133. However, these patents are cited only as examples to show the existence of such dispensers and are not necessarily intended to be the exact design or designs of propel-repel devices that ultimately are used for the oral hygiene device.

The center section 17 of the case 15 includes a center rim 23. The case 15 most likely is tubular in shape for ease of production as well as convenience of use, but a square, rectangular or even oval cross section is possible. Extending in both directions from the center rim 23 are a pair of lips 25 having a diameter or size smaller than the center rim 23 but larger than the brush mount 19 and the dentifrice mount 21.

The toothbrush 11 and the dentifrice 13 are both covered by caps 27. The caps 27 are shaped to fit securely over the lips 25 and abut the center rim 23. The caps 27 may be clear or opaque or completely block sight of the dentifrice 13 and the toothbrush 11. The cap 27 to be placed over the toothbrush 11 preferably has small openings 29 about its end to permit ventilation for the toothbrush 11 to permit the toothbrush 11 to dry after each use.

In use, first the cap 27 over the dentifrice mount 21 is removed and, if a propel-repel design is used, the dentifrice is extended. The cap 27 over the toothbrush 11 is left in place to use as a handle to apply the dentifrice 13 by rubbing the dentifrice 13 on the teeth. The dentifrice 13, which has a consistency similar to lip stick, is rubbed on the teeth, most likely the front teeth. The cap 27 is then placed back over the dentifrice 13 and the cap 27 located over the toothbrush 11 is then removed and the toothbrush 11 is then used in the usual manner. A limited amount of water is of assistance, but the teeth can be cleaned without water if the situation so requires.

The production of the dentifrice as a semi-hard stick is vital to the oral hygiene device. Possibly other formulas for the production of a semi-hard stick of dentifrice will be developed. Any other such semi-hard stick dentifrice 13 in the form of a semi-hard stick could be used with the oral hygiene device. One dentifrice 13 that is semi-hard and which works satisfactory as the dentifrice 13 in the oral hygiene device includes ingredients as follows:

| INGREDIENTS | PURPOSE |
|---|---|
| Baking Soda | Abrasive cleanser |
| Calcium Ion | Carrot Derivative - Protects Tooth Enamel |
| Calcium Carbonate | Mineral Polishing Agent - Natural Chalk |
| Glycerin | Moisturizer and Binder |
| Sodium Lauryl Sulphate | Coconut Oil Derivative - Foaming Cleanser |
| Carrageenin | Sea Kelp Gel - Soothing Agent for Gums |
| Oil of Peppermint | Flavoring |
| Calcium Ascorbate | A Form of Vitamin C - Good for Gums |
| Sea Salt | Cleanser |

The above ingredients are combined in the following manner:

Equal amounts of baking soda and all of the above listed ingredients, with the exception of glycerin, in an amount approximately by volume twenty percent (20%) of the mixture of baking soda with the other ingredients. The mixture is formed into a desired shape and allowed to dry for five to ten hours.

The vital ingredients are baking soda mixed with glycerin as a binder and a moisturizer. This combination alone will provide a dentifrice but the benefits of the various other ingredients listed above will be lacking.

It is to be understood that the drawings and description matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

I claim:

1. An oral hygiene device for brushing teeth comprising:

a case including a center section, a brush mount, a dentifrice mount and a pair of caps, the caps being mounted detachably on the center section, the brush mount and the dentifrice mount extending in opposite directions from the center section and being within the caps; and a semi-hard dentifrice mounted within the dentifrice mount and a toothbrush mounted within the brush mount, the semi-hard dentifrice being in a stick for rubbing directly on the teeth.

2. An oral hygiene device according to claim 1 wherein the dentifrice mount includes a propel-repel mechanism.

3. An oral hygiene device according to claim 1 wherein both the dentifrice mount and the brush mount include a propel-repel mechanism.

4. An oral hygiene device according to claim 1 wherein the center section includes a center rim which is larger than the brush mount and the dentifrice mount.

5. An oral hygiene device for brushing teeth comprising:

a case including a center section, a brush mount, a dentifrice mount and a pair of caps, the center section including a center rim and a pair of lips, the lips being smaller than the center section and larger than the dentifrice mount and the brush mount, the caps being detachably mounted on the lips of the center section, the brush mount and the dentifrice mount extending in the opposite directions from the center section; and a semi-hard dentifrice mounted within the dentifrice mount and a toothbrush mounted within the brush mount.

6. An oral hygiene device according to claim 5 wherein one cap has ventilation openings.

7. An oral hygiene device for brushing teeth comprising:

a case including a center section, a brush mount, a dentifrice mount and a pair of caps, the center section including a center rim and a pair of lips, the lips being smaller than the center section and larger than the dentifrice mount and the brush mount, the caps being detachably mounted on the lips of the center section, the brush mount and the dentifrice mount extending in opposite directions from the center section, one cap having ventilation openings; and a semi-hard dentifrice mounted within the dentifrice mount and a toothbrush mounted within the brush mount, the semi-hard dentifrice being in a stick for rubbing directly on the teeth.

* * * * *